US007201350B2

(12) United States Patent
Sugita et al.

(10) Patent No.: US 7,201,350 B2
(45) Date of Patent: Apr. 10, 2007

(54) SIGNALING SAFETY SYSTEM

(75) Inventors: Yoichi Sugita, Hitachi (JP); Dai Watanabe, Hitachi (JP); Masakazu Akiyama, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 59 days.

(21) Appl. No.: 10/921,167

(22) Filed: Aug. 19, 2004

(65) Prior Publication Data

US 2005/0133673 A1 Jun. 23, 2005

(30) Foreign Application Priority Data

Dec. 22, 2003 (JP) ..... 2003-425291

(51) Int. Cl.
*G05D 1/00* (2006.01)

(52) U.S. Cl. ..... 246/122 R; 246/182 R; 246/3; 246/4; 707/20; 707/19

(58) Field of Classification Search ..... 246/122 R, 246/122 A, 182 R, 20, 27, 28 R, 62, 124, 246/167 R, 182 B, 473 R, 3, 4, 15; 701/19, 701/20

See application file for complete search history.

(56) References Cited

U.S. PATENT DOCUMENTS 3,888,437 A * 6/1975 Birkin ..... 246/63 A
4,735,383 A * 4/1988 Corrie ..... 246/3
5,332,180 A * 7/1994 Peterson et al. ..... 246/3
5,398,894 A * 3/1995 Pascoe ..... 246/28 R
5,533,695 A * 7/1996 Heggestad et al. ..... 246/62
5,740,547 A * 4/1998 Kull et al. ..... 701/19
5,809,448 A * 9/1998 Gimenez et al. ..... 701/213

(Continued)

FOREIGN PATENT DOCUMENTS

GB 1033105 A 6/1966

(Continued)

OTHER PUBLICATIONS

Signal & Draht, Tetzlaff, Hamburg, De, vol. 57, No. 2, Feb. 1965, XP-001147332 ISSN: 0037-4997 (pp. 17-29).

(Continued)

*Primary Examiner*—Mark T. Le
(74) *Attorney, Agent, or Firm*—Crowell & Moring LLP

(57) ABSTRACT

A signaling safety system includes transmitter-receiver units for ground-train communication by radio in regular safety operation mode, using a base station and an antenna. The position of each train car is communicated from the cars to a ground train controller which detects the presence of a train on-rail. Based on the latter information, information is transmitted from the controller to each of the cars regarding corresponding speed limits. In addition to such radio transmitter-receivers, the signaling safety system also includes additional communication devices, such that, when each of the cars approaches a specific range, car information from each of the cars can be received by the controller, by communication between ground communication devices and an on-train communication device which are installed so as to communicate with each other. Concurrently with the regular safety operation, by the alternative safety system, the presence on-rail of each of the cars is controlled for each new block section. When ground-train communication by radio fails, the controller switches to operation by the alternative safety system so that safe operation of the train can be continued.

6 Claims, 17 Drawing Sheets

U.S. PATENT DOCUMENTS 5,950,966 A * 9/1999 Hungate et al. ..... 246/62
6,135,396 A * 10/2000 Whitfield et al. ..... 246/182 R
6,511,023 B2 * 1/2003 Harland ..... 246/122 R
6,666,411 B1 * 12/2003 Hart et al. ..... 246/62

FOREIGN PATENT DOCUMENTS

JP 2002-247035 8/2002
JP 2003-011819 1/2003

OTHER PUBLICATIONS

European Search Report dated Aug. 14, 2006 (Three (3) pages).

* cited by examiner

FIG. 5(A)
401 EXISTENCE ON-RAIL CONTROL TABLE
| BLOCK NO. | B1 | B2 | B3 | B4 | B5 | ····· |
|---|---|---|---|---|---|---|
| TRAIN NO. | t1 | t1 | Φ | Φ | Φ | ····· |
| TRAIN POSITION | t50m | h100m | | | | |
FIG. 5(B)
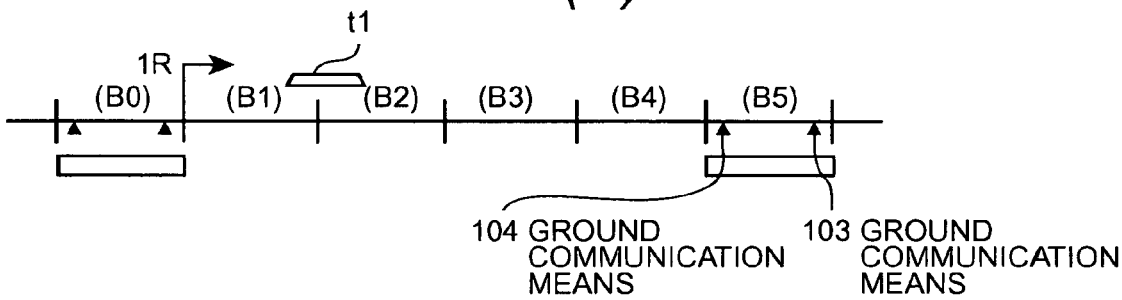
FIG. 6(A)
408 EXISTENCE ON-RAIL CONTROL TABLE
| BLOCK NO. | 1 | 2 | 3 | 4 | ····· | N |
|---|---|---|---|---|---|---|
| TRAIN NO. | Φ | t1 | Φ | Φ | ····· | Φ |
FIG. 6(B)
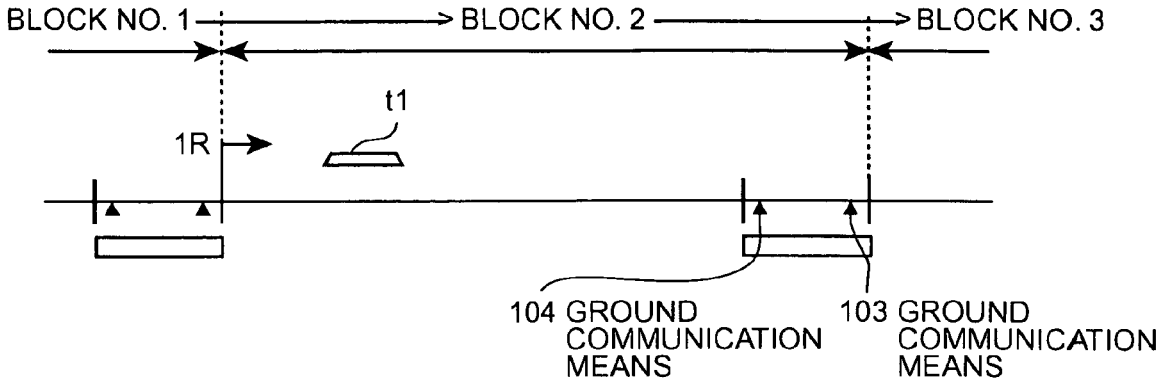

1600 EXISTENCE ON-RAIL CONTROL TABLE

| BLOCK NO. | STATION I-1 | STATION I (OWN STATION) | STATION I-1 |
|---|---|---|---|
| TRAIN NO. | Φ | t1 | Φ |

SIGNALING SAFETY SYSTEM

BACKGROUND OF THE INVENTION

1. Field of the Invention

The present invention relates to a signaling safety system for a transit system moving on a track, such as railroads, monorails, and LRT (light rail transit: next generation streetcar). More particularly, the invention provides a signaling safety system that is operable when each train approaches a specific range, using radio communication devices that are installed respectively on the ground and train. When ground communication by radio cannot be used, the invention provides for switching from operation via ground-train radio communication to the operation by additional communication devices.

2. Description of the Related Art

In a conventional railroad signaling safety system, train detectors called track circuits are installed on all tracks and are used to confirm the presence of a train on-rail. However, installation expenses of track circuits and maintenance expenses are enormous, so that a railroad system in which the need for track circuits is eliminated is currently sought. One system that is being considered, for example, detects the presence of a train on-rail and performs train control by the ground-train communication by radio, with each train confirming its own position by integrating the number of revolutions of the axle, and notifying the management section on the ground. Thus the ground side manages the positions of all trains.

However, to cancel an error in position calculation by the integral value of the number of revolutions of the axle, on the ground, balises having position information are installed as required, and when a train passes each balise, the position information from the balise is received by the train, thus an error in position calculation is canceled periodically, and correct position information can be obtained. According to this system, on each train, a radio communication means may be installed, and on the ground side, a radio communication base station may be installed, and furthermore in necessary portions on the track, balises for position correction may be installed, and track circuits are completely abolished. Thus the installation and maintenance expenses can be cut down greatly.

Meanwhile, in Patent Document 1, even when an error is caused in a cable communication route generally used and failure information generated in the system cannot be notified to the outside of the system via the cable communication route, the cable communication route is connected to a radio communication network as a backup communication route, thus the failure information can be notified to the outside of the system. Further, in Patent Document 2, without using rails or a loop antenna, transponder balises transmit a restricted speed signal or an incoming possibility discrimination signal to a car.

Patent Document 1: Japanese Application Patent Laid-Open Publication No. 2002-247035

Patent Document 2: Japanese Application Patent Laid-Open Publication No. 2003-11819

SUMMARY OF THE INVENTION

However, in radio signaling safety systems, confirmation of train existence on-rail and control must be executed by radio. Because radio is used as the communication medium, the effects of unavoidable interference such as disturbing radio waves and environmental changes, make it difficult always to maintain the communication quality above a fixed level. When such communication quality is not maintained, compared with the conventional track circuit system, the operation rate of the system is inevitably reduced.

An object of the present invention is to provide a signaling safety system that is operable even when a failure occurs in radio, and is capable of continuing confirmation of train presence on-rail and safety control by a backup system, thereby improving the operation rate.

Further, another object of the present invention is to provide a signaling safety system that is capable of confirming the presence of a train on-rail and continuing safety control, even when a failure occurs in an essential section of the backup system.

The present invention is directed to a signaling safety system of the type in which, using ground-train communication by radio, the position of each train is communicated to the ground equipment from an on-train device, as information regarding the presence of a train on-rail. Based on this information, information regarding speed restrictions is transmitted from the ground equipment to the on-train device of each of the trains, so that the speed of each of the trains is controlled. According to this invention, in such a system, when each of the trains approaches a specific range, by communication between additional communication devices installed on the ground and train, the system is capable of receiving car information from the on-train device of each of the trains by the ground equipment. In this manner, when the ground-train communication by radio cannot be used, the ground equipment can switch from operation of the ground-train communication by radio to operation using communication between the additional communication devices.

In an embodiment of the invention, communication between the additional communication devices installed on the ground and train is provided via a network including terminals connected respectively to the communication devices installed on the ground. The terminals are always equipped with respectively a part of the functions (presence on-rail control function) of the ground equipment; thus even when the ground equipment itself fails, the partial function is backed up by the respective terminals.

Even when a failure occurs in radio communication, confirmation of train presence on-rail and safety control can be continued by the backup system, and the operation rate can be improved. According to the invention, after such a failure occurs, confirmation of train presence on-rail and safety control can be continued, even when a further failure occurs in an essential section of the backup system, and at least confirmation of train existence on-rail can be continued. Furthermore, in the radio system, position detection estimating errors such as transmission delay occur, so that quick confirmation of incoming and outgoing in the station yard is difficult. However, according to the invention, communication devices are installed in the station yard, so that quick confirmation of incoming and outgoing is enabled and the safety can be improved.

BRIEF DESCRIPTION OF DRAWINGS

FIG. 5(A) is a table showing a constitution example of an existence on-rail control table for regular safety of the ground train controller; and FIG. 5(B) is a schematic diagram of a track.

FIG. 6(A) is a table showing a constitution example of an existence on-rail control table for substitutive safety of the ground train controller; and FIG. 6(B) is a schematic diagram of a track.

100: Car, 101: Ground controller, 102: (Radio) Base station, 103 and 104: Ground communication means (communication device), 107: Antenna, 108: Control LAN, 109: Terminal, 205 and 206: On-train communication means (communication device), 200: On-train controller, 1700: LCX, 1701: Base station, 1702: LCX antenna.

DESCRIPTION OF THE PREFERRED EMBODIMENTS

An embodiment of the present invention will be explained below with reference to FIGS. 1 to 18.

Figure 1:
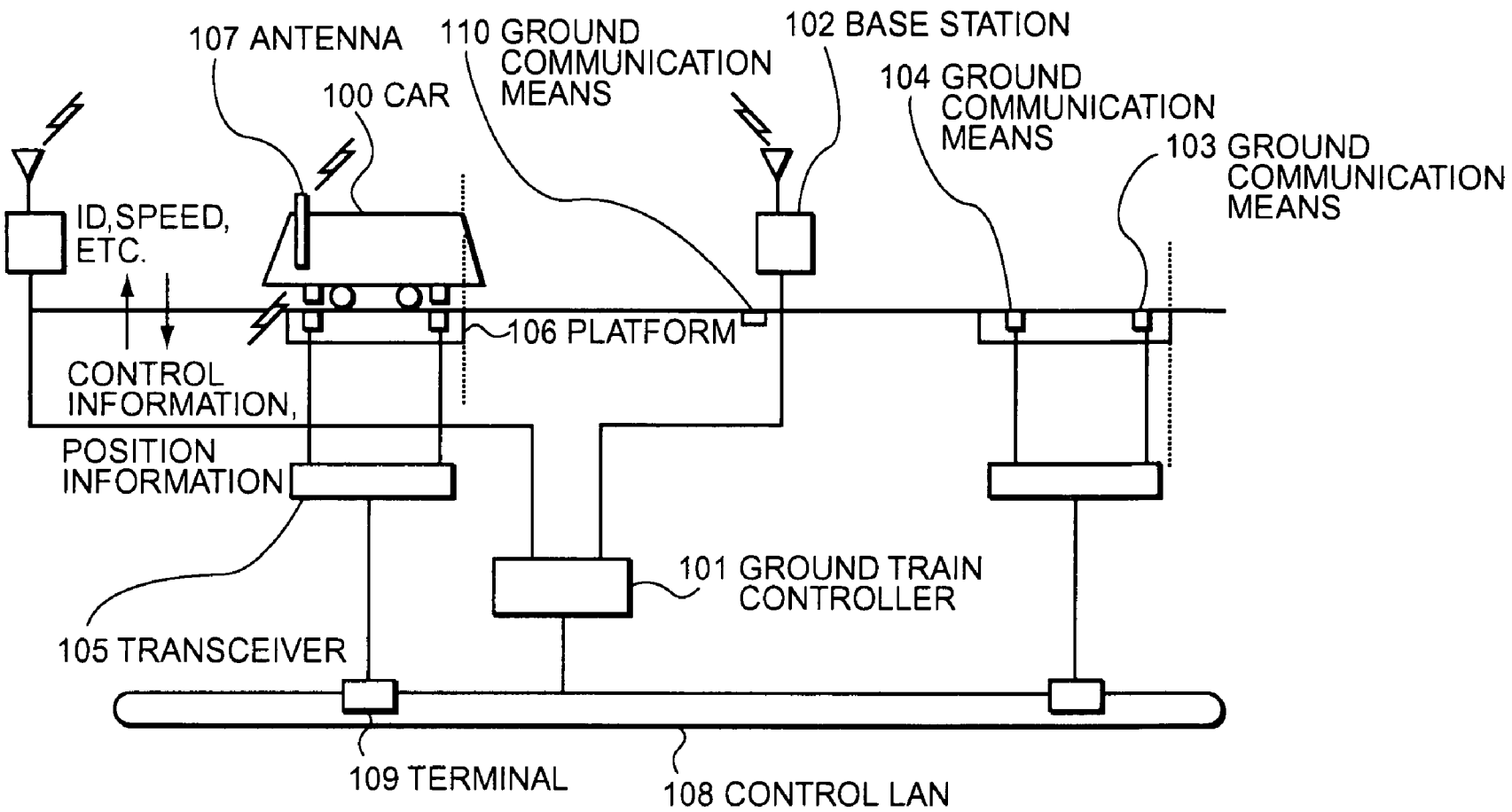
FIG. 1 is a diagram showing the whole schematic system configuration of an example of the signaling safety system of the present invention.

Firstly, the signaling safety system of the present invention will be explained. The whole schematic system configuration as an example is shown in FIG. 1. As shown in FIG. 1, the system is composed of a car 100 to be controlled, a ground train controller (equivalent to a main ground device) 101 which is a central processor on the ground side, a (radio) base station 102, ground communication means (communication devices relating to the present invention equivalent to two-way balises) 103 and 104 which are narrow-area (less than 1 m) radio communication means, a transponder 105, an antenna 107, a control LAN 108, a terminal 109, and a ground communication means (single-way balise) 110.

Among them, the radio communication means (installed at least on a platform 106 of each station) 103 and 104 are connected to the ground train controller 101 via the transponder 105 and the terminal 109 and the ground communication means 110 is independently installed without being connected to the ground train controller 101. Further, the ground train controller 101 communicates with the car 100 by radio via the base station 102 and the antenna 107, thereby executes detection of train existence (presence) on-rail and train control. Further, the car 100 communicates with the ground train controller 101 by radio via the antenna 107 and the base station 102, thereby transmits its own position to the ground side, and moreover receives the movable area boundary (hereinafter referred to as the stop limit) from the ground train controller 101 and controls its own speed not to exceed the stop limit, thus the safety is maintained. For the car 100, as described later, the number of revolutions of the axle is integrated, thus its own position is calculated as a movement distance, and whenever installation position information is received respectively from the ground communication means 103, 104, and 110, the movement distance calculated until then is corrected by the installation position information.

On the other hand, the ground train controller 101 receives state information such as car identification information (car ID), speed information, and moving direction information from the car 100 via the control LAN 108, the terminal 109, the transponder 105, and the ground communication means 103 and 104, thereby confirms train transition before and after the ground communication means 103 and 104, and controls existence on-rail, and furthermore, transmits the stop limit to the car 100 via the ground communication means 103 and 104, thus the train control similar to the aforementioned is executed. However, these processes, when the signaling safety by radio communication using space waves via the base station 102 and the antenna 107 cannot be used due to a radio failure, are a signaling safety function executed in substitution. Hereinafter, the signaling safety control by radio communication using space waves via the base station 102 and the antenna 107 is defined as "regular safety" and the signaling safety control by the ground-train communication using the ground communication means 103 and 104 is defined as "substitutive safety". During execution of the regular safety, detection of existence on-rail by the substitutive safety is executed. This is backup and the train control by the stop limit is not executed.

Figure 2:
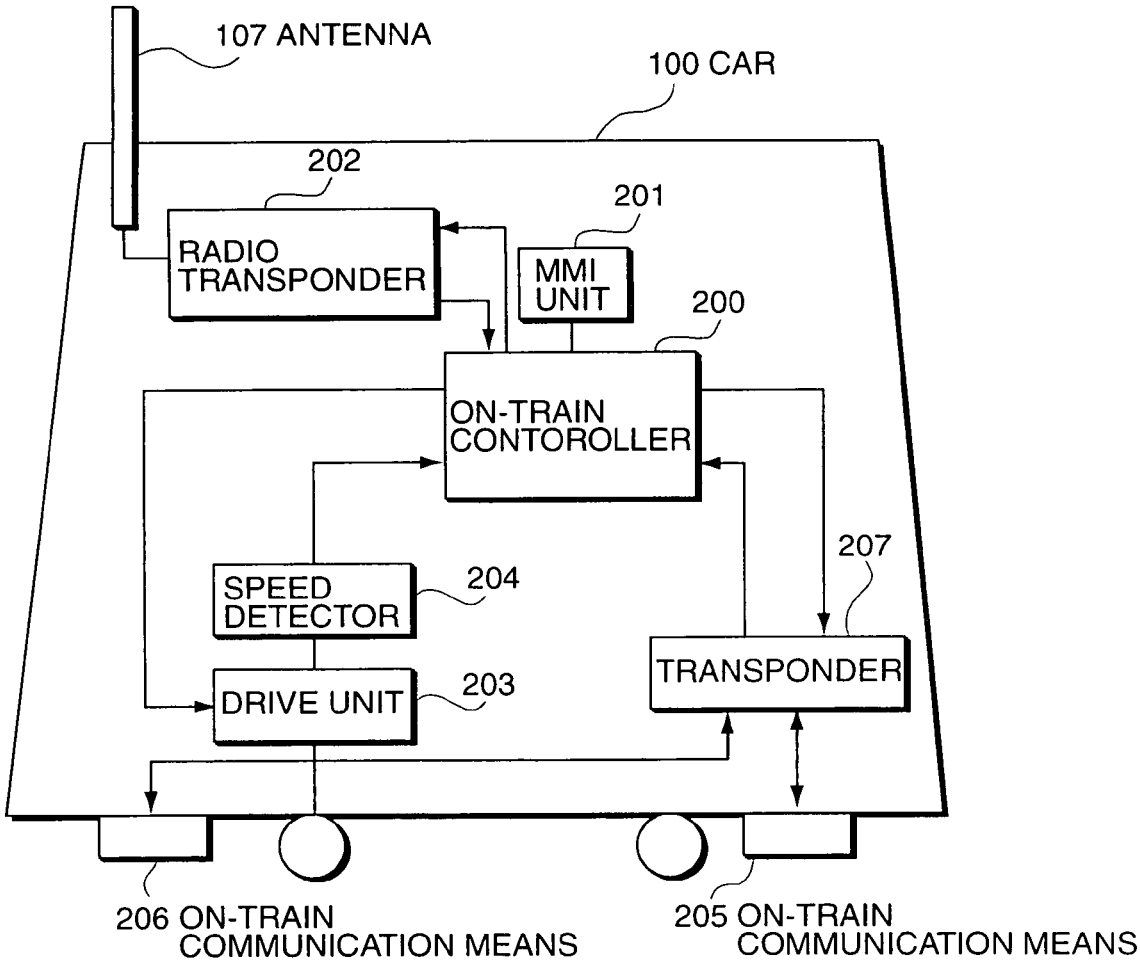
FIG. 2 is a diagram showing the constitution of an example of the car relating to the present invention.

Furthermore, the car 100 relating to the present invention will be explained. The constitution of an example thereof is shown in FIG. 2. As shown in the drawing, the car 100 is mounted with an on-train controller 200, an MMI (man-machine interface) 201, a radio transponder 202, a drive unit 203, a speed detector 204, on-train communication means (communication devices relating to the present invention equivalent to two-way pickup coils) 205 and 206, a transponder 207, and an antenna 107 and among them, in the on-train controller 200, main functions such as own train position calculation and speed control based on the stop limit are executed. In the own train position calculation, from the speed detector 204 for monitoring the drive unit 203, the number of revolutions of the axle is obtained, and it is integrated by the on-train controller 200, thus the own train position is calculated as a movement distance. Further, transmission of the own train position information for the regular safety and reception of the stop limit are executed by the radio transponder 202 and the antenna 107.

Furthermore, the on-train communication means 205 and 206 communicate with the ground communication means 103, 104, and 110, thus reception of the position information during the regular safety, transmission of the car identification information, speed information, and moving direction information during the substitutive safety, and reception of the stop limit are used for the ground-train communication. Meanwhile, at least two on-train communication means are required and generally, among the on-train communication means 205 and 206, the on-train communication means 205 is mounted in the leading car of the train and the on-train communication means 206 is mounted in the rearmost car thereof. On the other hand, at least one ground communication means is required, thus among the ground communication means 103 and 104, either of them is not always necessary.

Figure 3:
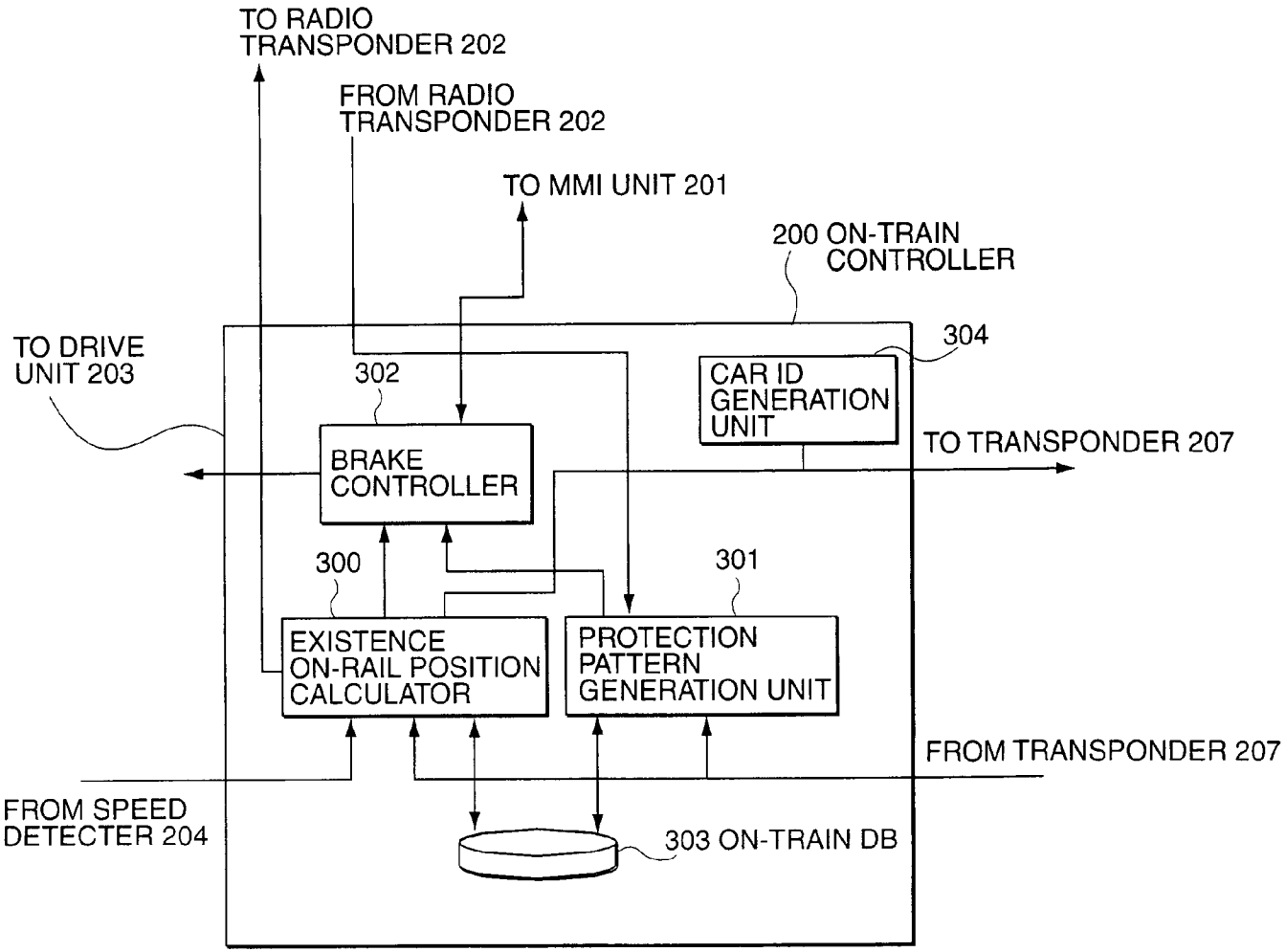
FIG. 3 is a diagram showing the internal constitution of an example of an on-train controller mounted on the car.

As mentioned above, the on-train controller 200 is necessary for various kinds of processing and control and the inner constitution of an example thereof is shown in FIG. 3. As shown in the drawing, the on-train controller 200 is composed of an existence on rail position calculator 300, a protection pattern generation unit 301, a brake controller 302, an on-train DB (data base) 303, and a car ID generation unit 304. Among them, in the existence on-rail position calculator 300, on the basis of the information of the number of revolutions of the axle from the speed detector 204, the number of revolutions of the axle is integrated, thus the position of the own train is calculated as a movement distance, and at that time, the present position is confirmed by the distance from the installation position of each of the ground communication means 103, 104, and 110 as a base point. At that time, to the radio transponder 202, the number of the radio communication means as a base point and the distance from there are transmitted. When there are a plurality of routes, the route identification information is also transmitted. In the on-train DB 303, various kinds of track information (track configuration, slope, curve, station, and limited speed, hereinafter referred to as alignment information) are stored and if the absolute position can be confirmed using them, to the radio transponder 202, instead of the movement distance from the installation position of each of the base-point balises, it may be considered to transmit the absolute position information. Further, on the basis of the installation position information from each of the ground communication means 103, 104, and 110 which is received from the transponder 107, the distance information calculated until then is corrected and these processes are executed during the regular safety.

In the protection pattern generation unit 301, on the basis of the stop limit information from the ground train controller 101, a speed upper limit pattern (hereinafter called a protection pattern) which can be stopped is generated not to exceed it. For it, the alignment information such as the slope and speed limit information must be used, so that the pattern is generated by referring to the on-train DB 303. In the regular safety, the stop limit information is received by the base station 102 via the radio transponder 202, while in the substitutive safety, it is received by the ground communication means 103 and 104 via the transponder 207. In the brake controller 302, on the basis of a protection pattern generated by the protection pattern generation unit 301, using the own train position information from the existence on-rail position calculator 300 and the present speed information, whether the present speed information is higher than the speed on the protection pattern corresponding to the present position or not is decided. When the present speed is higher, a deceleration instruction is given to the drive unit 203. Further, the protection pattern, present position, and present speed information are transferred to the MMI unit 201 and then is displayed for an operator. Furthermore, in the car ID generation unit 304, car ID is generated and transmitted to the ground train controller 101 via the transponder 207, the on-train communication means 205 and 206, and the ground communication means 103 and 104. At that time, the information controlled by the existence on-rail position calculator 300 including the present speed information, moving direction information, and door switching information is also transmitted at the same time. The aforementioned information is always transmitted to the ground train controller 101 not only during the substitutive safety but also during the regular safety.

Figure 4:
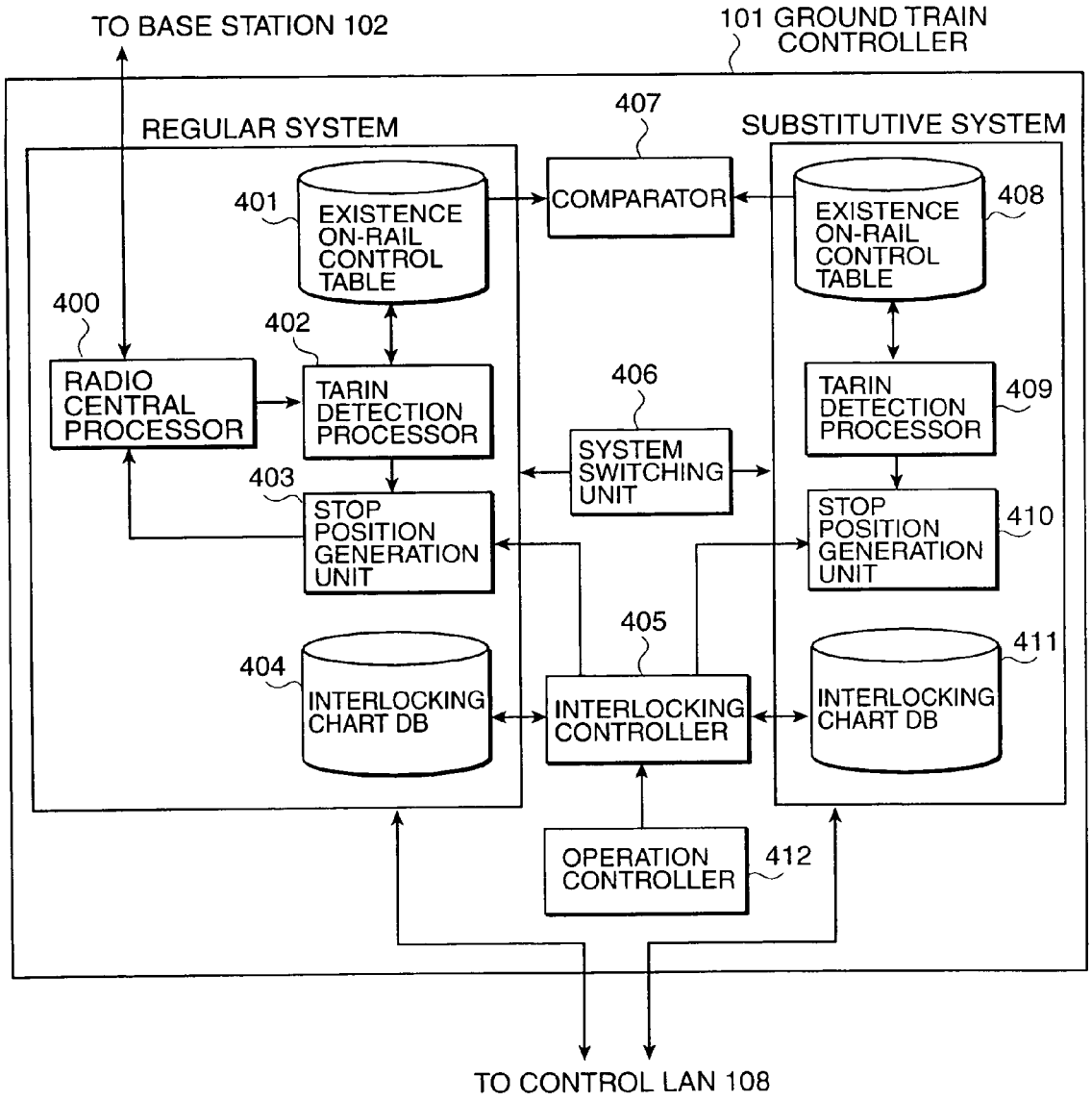
FIG. 4 is a diagram showing the internal constitution of an example of a ground train controller.

On the other hand, the constitution of an example of the ground train controller 101 is shown in FIG. 4. As shown in the drawing, the ground train controller 101, as functions for the regular safety, has a radio central processing unit 400, an existence on-rail control table 401, a train detection processor 402, a stop position generation unit 403, and an interlocking chart DB 404 and as functions for the substitutive safety, has an existence on-rail control table 408, a train detection processor 409, a stop position generation unit 410, and an interlocking chart DB 411 In addition to them, the ground train controller 101, as common functions, has an interlocking controller 405 and an operation management unit 412 and as functions for controlling both the regular safety and substitutive safety, has a comparator 407 and a system switching unit 406.

Here, firstly, the process by the train detection processor 402 will be explained. In the train detection processor 402, on the basis of the train position information transmitted from the car 100 via the base station 102, the existence on-rail state for the overall management district is arranged and by the arrangement result, the existence on-rail management table 401 is updated. In the existence on-rail management table 401, the existence on-rail state of each of all trains existing on the main track is recorded. In FIG. 5(A), a constitution example of the existence on-rail management table 401 is shown. As shown in the schematic diagram of the track shown in FIG. 5(B), the track is divided into blocks B0 to B6 and it is recorded that each of trains is set at any position from the top of what block, thus the position is confirmed. In the example shown in FIG. 5(B), the head of the train is positioned at a distance of 100 m from the head of the block B2, and the rearmost part of the train is positioned at a distance of 50 m from the head of the block B1, so that in the block B1, "t 50 m" (=tail 50 m) is recorded, and in the block B2, "h 100 m" (=head 100 m) is recorded. After all, on the existence on-rail control table 401, in the blocks B1 and B2, the train of train No. t1 exists, so that in the blocks B1 and B2, "t1" is recorded, though in the blocks B3 to B5, no trains exist, so that in the blocks B3 to B5, "Φ" indicating no existence is recorded.

Further, in the stop position generation unit 403, on the basis of the train position information calculated by the train detection processor 402, the stop limit is generated for each train and is transmitted to the car 100 via the radio central processor 400, the base station 102, and the antenna 107. When there are a plurality of routes in the train moving direction at the time of generation of the stop limit, the route reservation state by the interlocking controller 405 is added and it will be described later in detail. In the interlocking controller 405, according to an instruction from the operation management unit 412, the interlocking chart DB 404 in which the operation conditions of the point corresponding to the route are recorded so as to reserve the necessary route is referred to, thus the route is reserved.

On the other hand, in the train detection processor 409 used for the substitutive safety, using the information such as the car ID, speed information, and moving direction information which are obtained via the ground communication means 103 and 104, the transponder 105, and the control LAN 108, the transition state of the train is confirmed, thus the existence on-rail distribution is controlled. The existence on-rail distribution is stored in the existence on-rail control table 408 and a constitution example of the existence on-rail control table 408 is shown in FIG. 6(A). As shown in the schematic diagram of the track shown in FIG. 6(B), in the substitutive safety, the train transition before and after the ground communication means 103 and 104 is confirmed, thus the existence on-rail state is controlled, so that fixed block sections using the ground communication means 103 and 104 as a boundary are installed, and on condition that only one train is permitted to exist in one block section, existence and non-existence are controlled for each block section. In the example shown in FIG. 6(B), only in the block section of block No. 2, a train of train No. "t1" exists, so that in the existence on-rail control table 408, "t1" is described only in the column of block No. 2. In the columns of block Nos. 1, 3, 4, - - - , and N other than the column of block No. 2, "Φ" indicating no existence is recorded.

As mentioned above, in the substitutive safety, an operation is performed that in the block section using the ground communication means 103 and 104 as a boundary, only one train is permitted to exist. However, in the regular safety, an operation in a higher density may be considered, so that in the train detection process which will be described later, passing the block boundary is detected and a plurality of trains existing in the block section are confirmed. In this case, in the existence on-rail control table 408 shown in FIG. 6(A), in one block No., No s. of a plurality of trains (for example, in block No. 2, "t1" and "t2" are recorded) are recorded. Further, in the stop position generation unit 410, on the basis of the train existence on-rail distribution calculated by the train detection processor 409, the stop limit is generated for each train and is transmitted to the car 100 via the control LAN 108, the terminal 109, the transponder 105, and the ground communication means 103 and 104. When there are a plurality of routes in the train moving direction, in the same way as with the regular safety, the route reservation state by the interlocking controller 405 is added. The process of the interlocking controller 406 is basically the same as that of the regular safety. However, in the substitutive safety, the track control unit is different, so that the interlocking chart DB 411 provided for the substitutive safety is referred to.

In the comparator 407 as a function for controlling both the regular safety and substitutive safety, the table contents are compared between the existence on-rail control tables 401 and 408, and whether the contents are always consistent with each other or not is monitored, and as a result of monitoring, when an error is found, it is reported to an operator. Similarly, in the system switching unit 406 as a function for controlling both the regular safety and substitutive safety, by monitoring the normal message reception state by the radio central processor 400, the operating state in the regular safety is confirmed and when the operating state is judged to be abnormal by monitoring, the regular safety is switched to the substitutive safety.

Meanwhile, in FIG. 4, the regular safety functions of "the radio central processor 400, the existence on-rail control table 401, the train detection processor 402, the stop position generation unit 403, and the interlocking chart DB 404" and the substitutive safety functions of "the existence on-rail control table 408, the train detection processor 409, the stop position generation unit 410, and the interlocking chart DB 411" can be mounted on the same control board, though it may be considered to mount them respectively on independent control boards, make them redundant, thereby improve the reliability. In this case, the functions common to the two such as "the interlocking controller 406, the comparator 407, and the system switching unit 406" are mounted on control boards having individually these functions. However, with respect to the interlocking controller 405, to improve the reliability thereof, it may be considered to mount the same controllers respectively on the control board whereon the regular safety functions are mounted and the control board whereon the substitutive safety functions are mounted.

Figure 7:
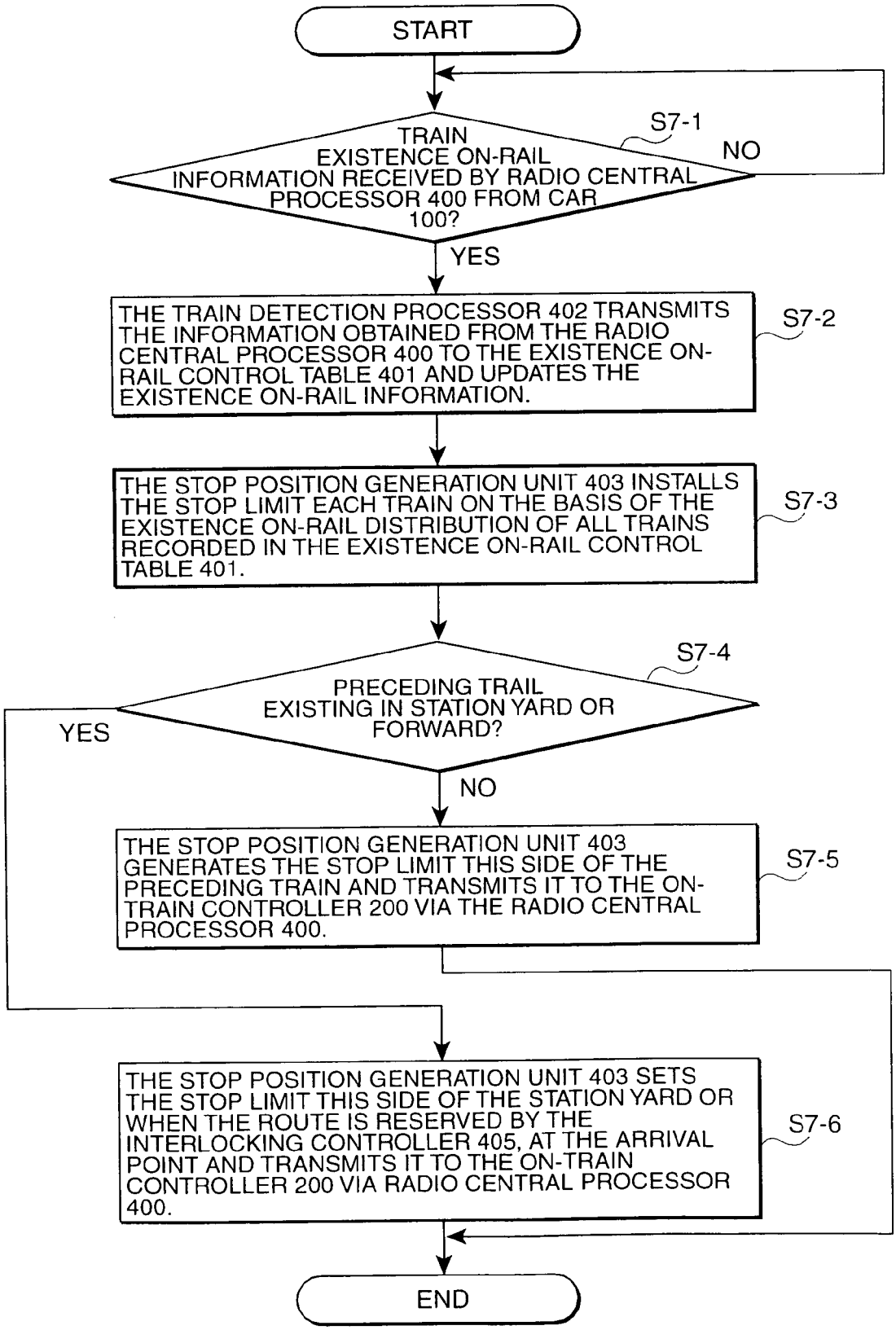
FIG. 7 is a flow chart showing a series of process flow example relating to the regular safety of the ground train controller.

Next, a series of processes relating to the regular safety of the ground train controller 101 will be explained. The process flow of an example thereof is shown in FIG. 7. In this case, firstly, at Step S7-1, the radio central processor 400 decides whether train existence on-rail information is received from the car 100 or not. If the decision shows that the information is not received, the process is returned to Step S7-1. However, when the information is received, it is transferred to the train detection processor 402 and Step S7-2 is executed. At Step S7-2, on the basis of the train existence on-rail information from the radio central processor 400, the position of each of all trains on the main track is confirmed and the existence on-rail control table 401 is up dated. Concretely, as described already, when the distance from the ground communication means 103 and 104 as a base point is received as existence on-rail information from the car 100, on the basis of it, as shown in FIG. 5(A), the existence on-rail of each of the trains is controlled in the state that the expression for each block is changed to and on the basis of the control result, the existence on-rail control table 401 is updated. Thereafter, at Step S7-3, in the stop position generation unit 403, on the basis of the existence on-rail distribution of all trains recorded in the existence on-rail control table 401, a process of installing the stop limit for each train is started.

Continuously, at Step S7-4, for each train, whether there is a preceding train for the concerned train in the station yard or forward beyond the station or not is decided. If the decision shows that there is no preceding train, at Step S7-5, the distance in consideration of transmission delay or overrun is added and the stop limit is set this side of the preceding train. The set stop limit is transmitted thereafter to the car 100 from the radio central processor 400 via the base station 1202. Further, if the decision shows that there is a preceding train, at Step S7-6, whether the route in the station yard is reserved or not is decided by the interlocking controller 405. If it is reserved, in a case of stop, the stop limit is set at the stop position and in a case of passing through station, in the same way as with Step S7-5, the stop limit is set this side of the preceding train. Further, if the route is not reserved, the stop limit is set in the near-side block in the station yard and incoming into the station yard is avoided.

Figures 1, 8:
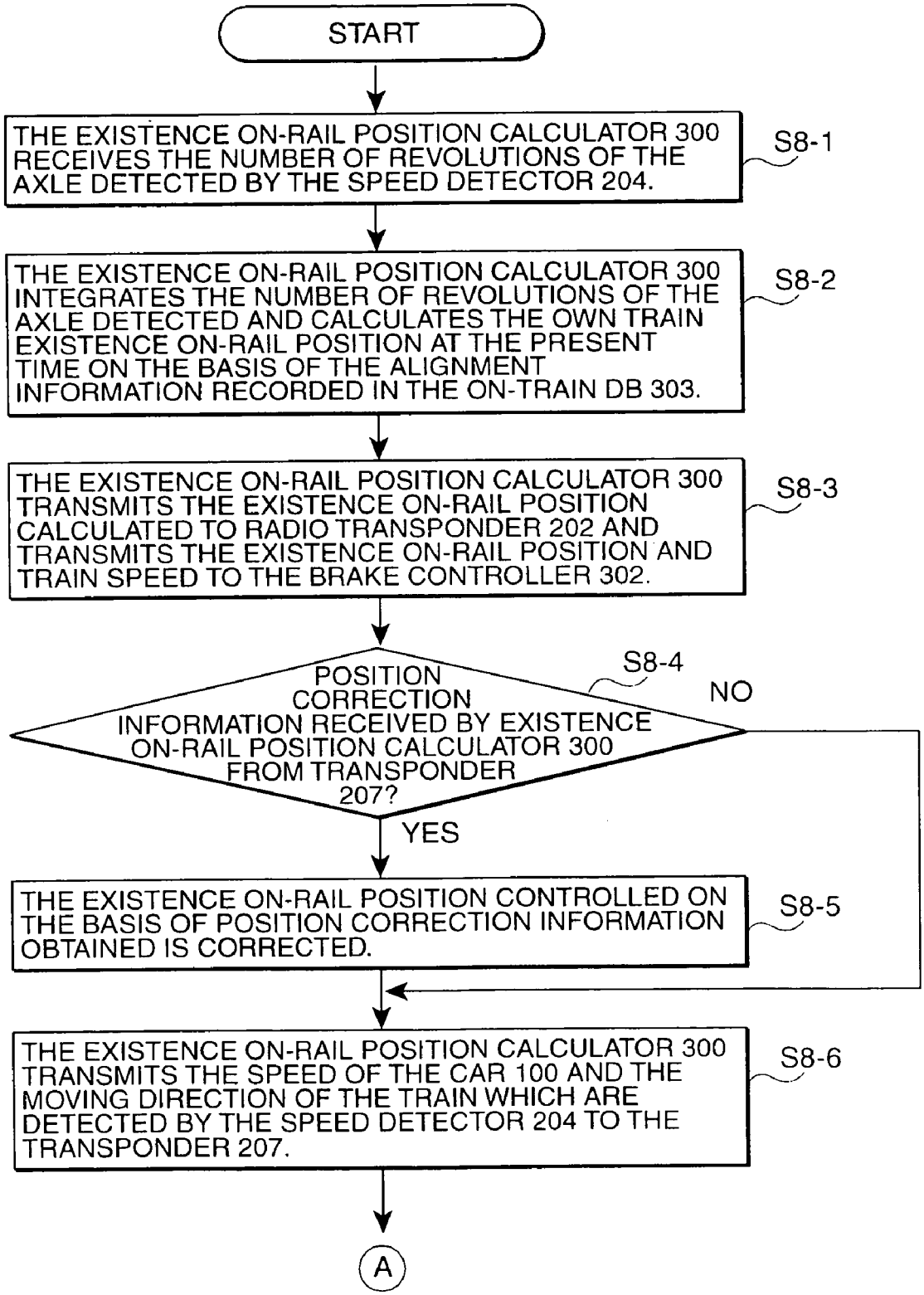
FIG. 8 is a flow chart showing a series of process flow example relating to the regular safety of the on-train controller.
Figures 2, 8:
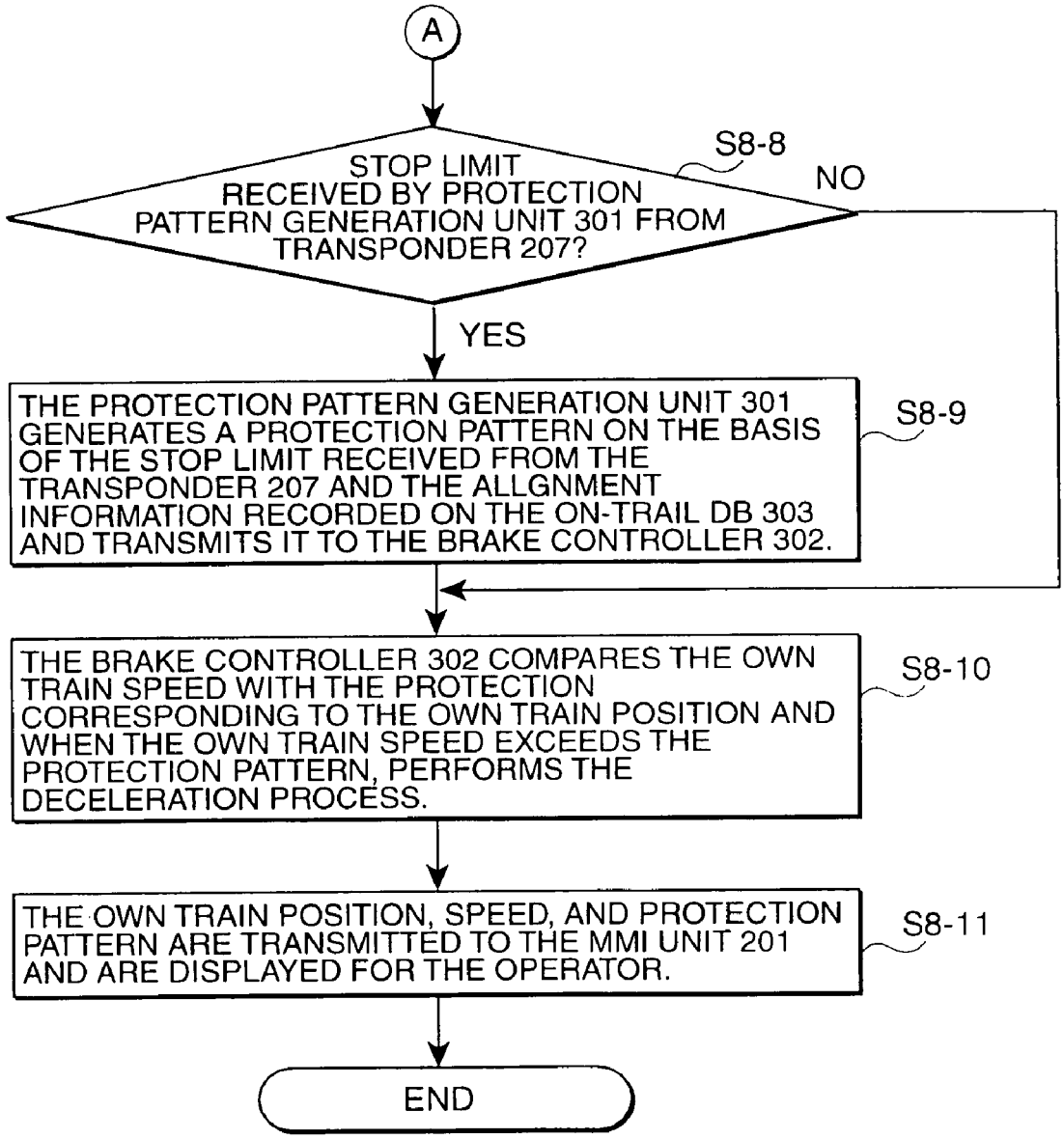

On the other hand, a series of processes relating to the regular safety of the on-train controller 200 will be explained. The process flow of an example thereof is shown in FIG. 8. In this case, firstly, at Step S8-1, in the existence on-rail position detector 300, the number of revolutions of the axle is received from the speed detector 204. Next, at Step S8-2, it is integrated, thus the distance from the ground communication means 103 and 104 as a base point is calculated as an existence on-rail position and at that time, the alignment information recorded on the on-train DB 303 is referred to. Continuously, at Step S8-3, the calculated existence on-rail position is transmitted to the ground train controller 101 via the radio transponder 202 and the present existence on-rail position and train speed are transmitted to the transponder 207. Thereafter, at Step S8-4, in the existence on-rail position calculator 300, whether the installation position information (position correction information) from the ground communication means 103, 104, and 110 is received via the transponder 207 or not is decided. If the decision shows that the information is received, at Step S8-5, the position information controlled until then is replaced with the installation position information at the reception timing. If the decision after Step S8-4 or at Step S8-4 shows that the installation position information is not received, at Step S8-6, in the existence on-rail position calculator 300, the information from the speed detector 204 such as the present speed of the car 100, train moving direction, and door opening direction is transmitted to the transponder 207 and the information is used for existence on-rail detection and train control in the substitutive safety.

Thereafter, at Step S8-7, the car ID of the car 100 is transmitted from the car ID generation unit 304 to the transponder 207. Continuously, at Step S8-8, whether the stop limit is received by the protection pattern generation unit 301 from the transponder 207 or not is decided. If the stop limit is received, at Step S8-9, in the protection pattern generation unit 301, on the basis of the stop limit received from the transponder 207 and the alignment information stored on the on-train DB 303, the protection pattern is generated and transfer red to the brake controller 302. Further, if the decision at Step S8-8 shows that the stop limit is not received or after execution of Step S8-9, Step S8-10 is executed. At Step S8-10, in the brake controller 302, the own-train speed and the protection pattern corresponding to the own-train position are compared, and if the own-train speed is higher than the protection pattern, a deceleration instruction is given to the drive unit 203, thus the car 100 is decelerated to prevent the own-train speed from exceeding the protection pattern. Thereafter, at Step S8-11, the own-train position, speed, and protection pattern are transmitted to the MMI unit 208 and are displayed for an operator.

Figure 9:
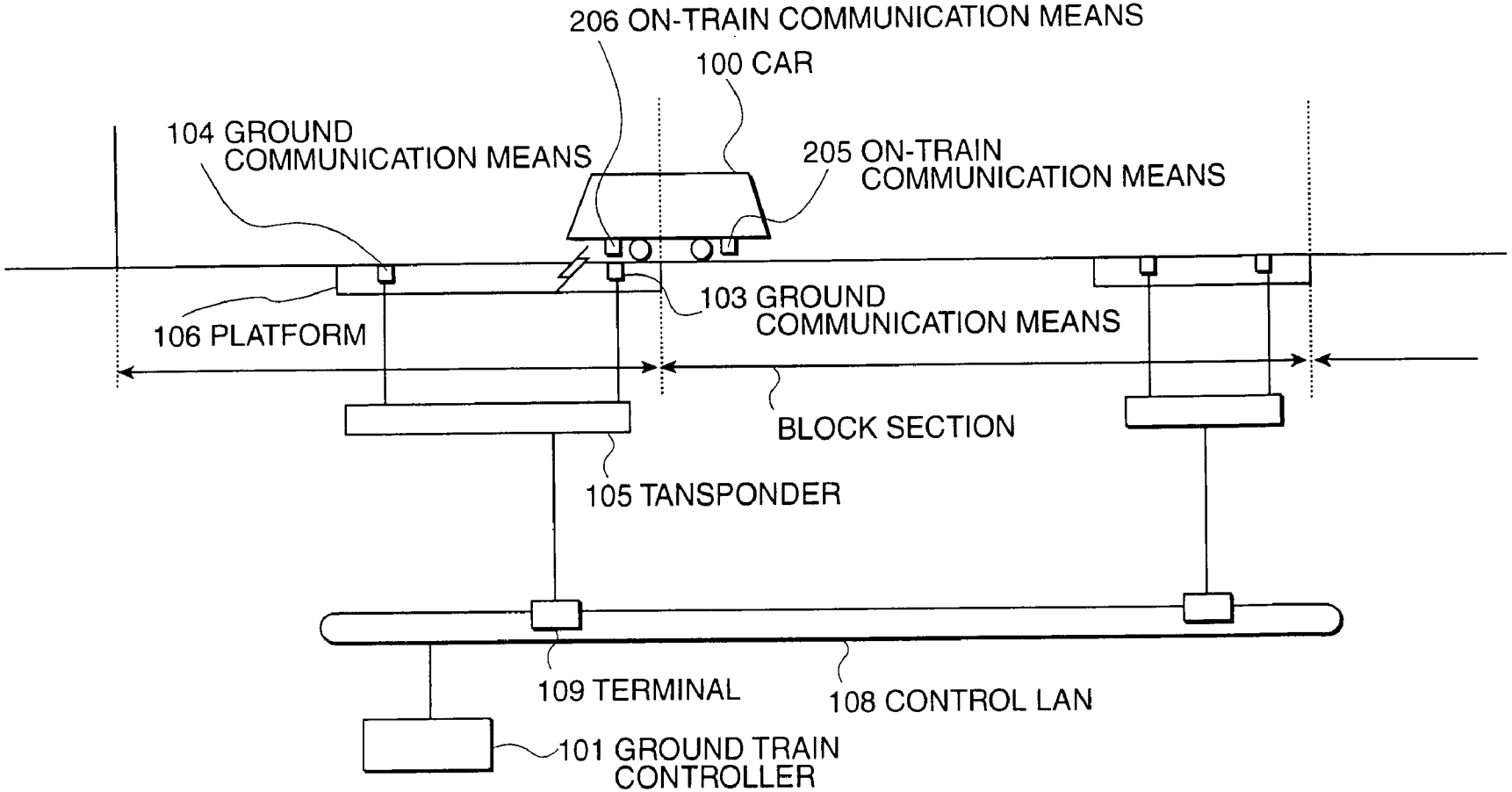
FIG. 9 is a diagram showing the constitution of devices necessary for the substitutive safety.

A series of processes relating to the regular safety in the ground train controller 101 and the on-train controller 200 is explained above. Here, the constitution of the devices necessary for the substitutive safety is shown in FIG. 9. In FIG. 9, the devices relating to radio, the base station 102, and the antenna 107 shown in FIG. 1 are omitted. In the substitutive safety, as described already, block sections using the ground communication means 103 and 104 as a boundary are defined and control that only one train is permitted to exist in one block section is executed. In the example shown in FIG. 9, as a block section 900 is shown, the ground communication means 103 and 104 are installed on the platform 106 of the station, thus the station is blocked. The most general operation, as shown in FIG. 9, is an operation of station block that the ground communication means 103 and 104 are installed on the platform 106 of the station.

Figure 10:
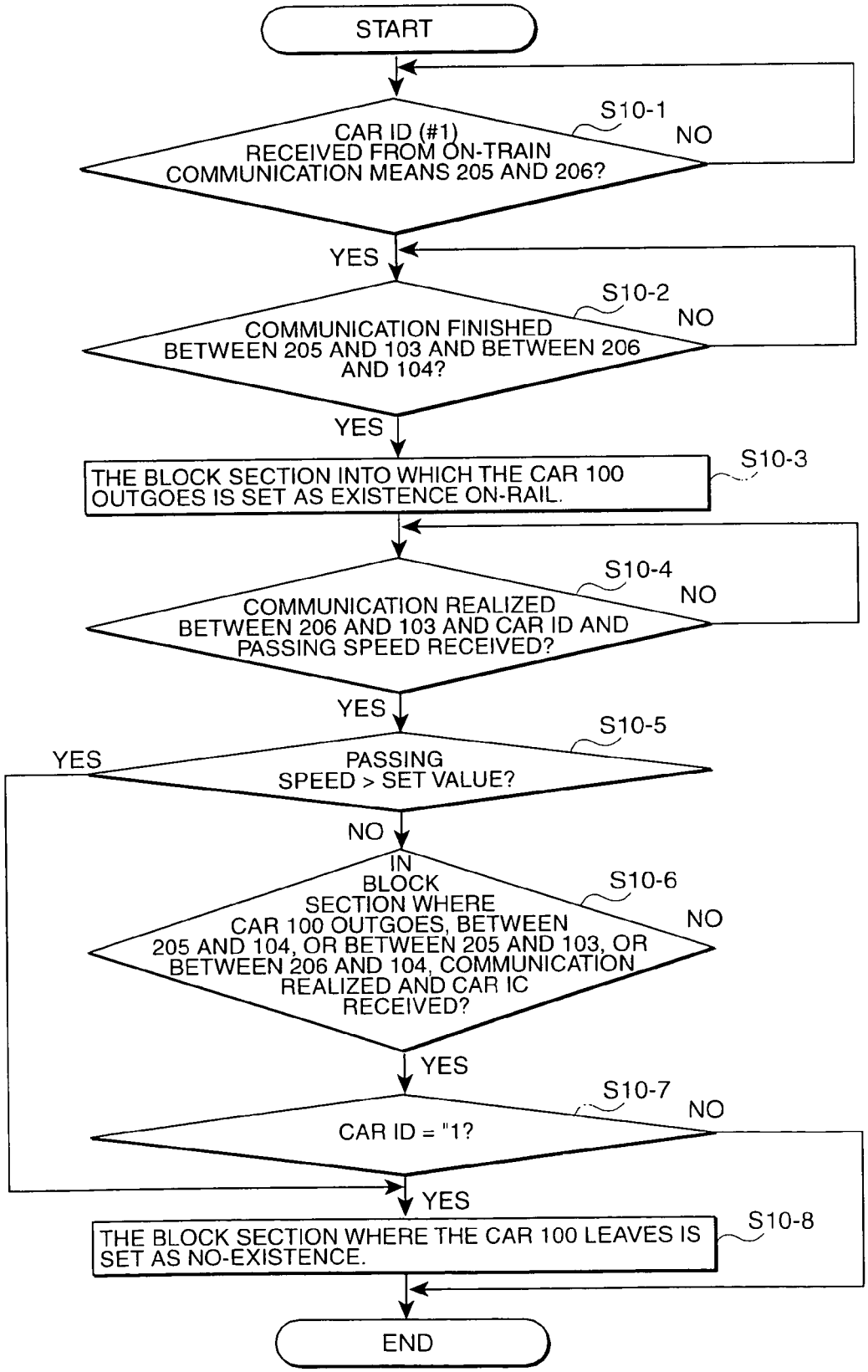
FIG. 10 is a flow chart showing the process flow of an example of the train detection process relating to the substitutive safety of the ground train controller.
Figure 11:
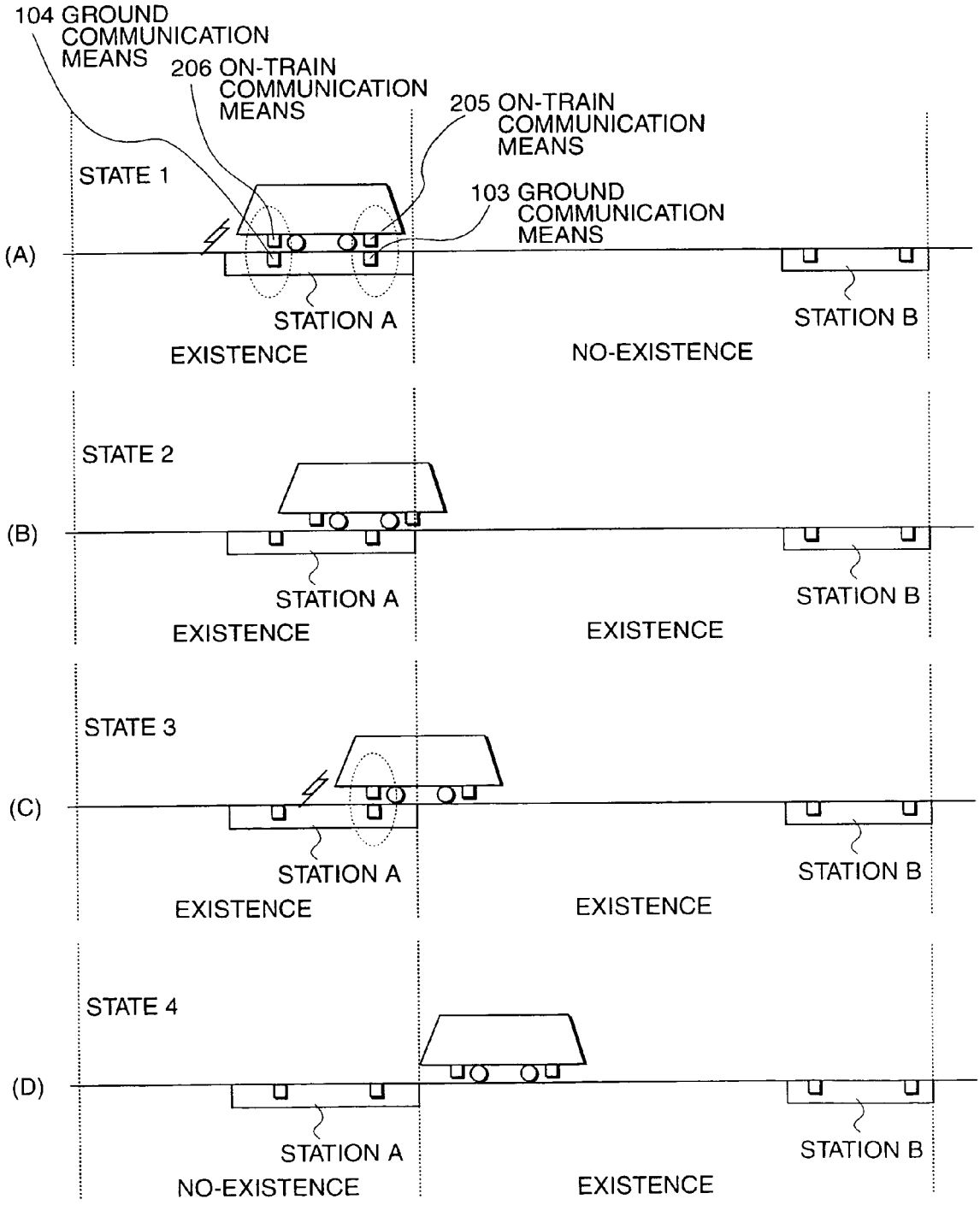
FIG. 11 is a schematic diagram (No. 1) for explaining the train detection process relating to the substitutive safety of the ground train controller.
Figure 12:
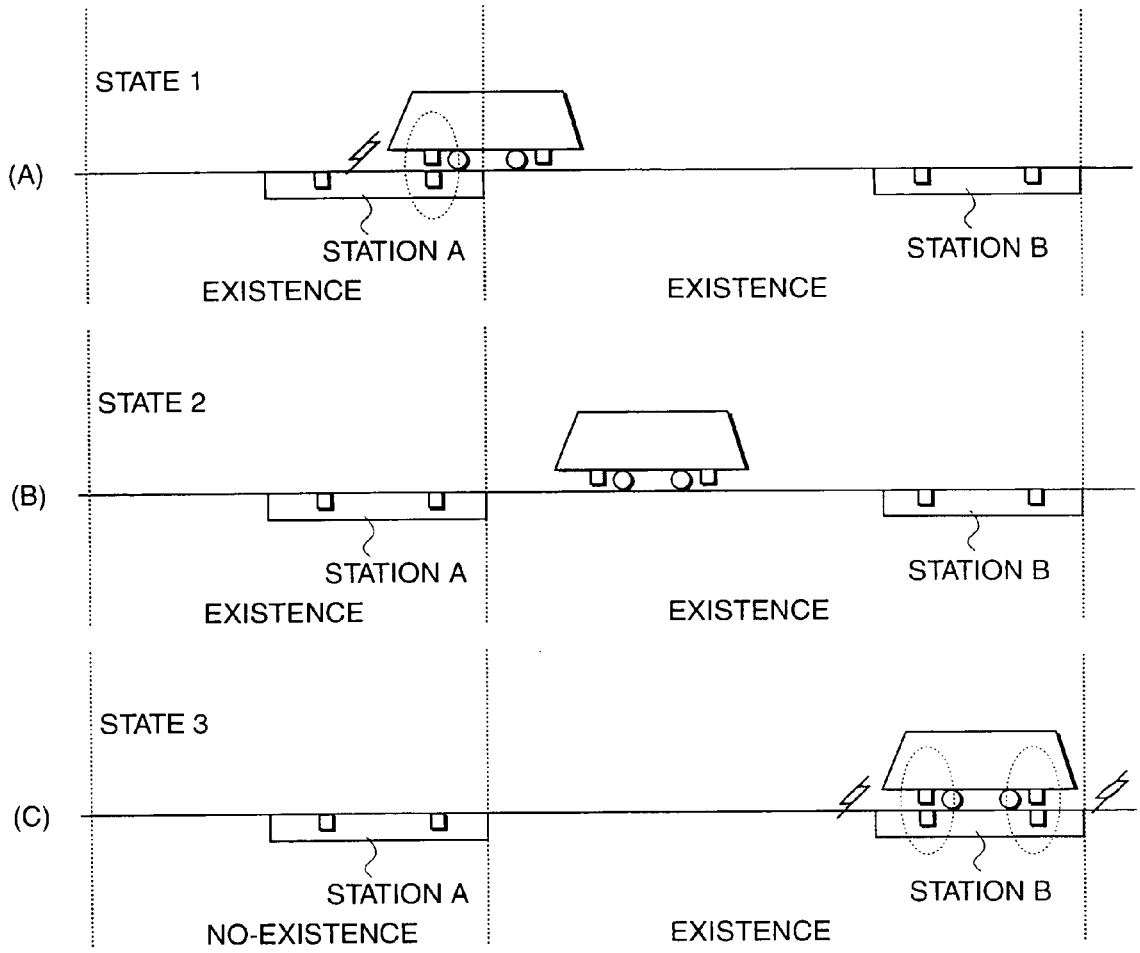
FIG. 12 is similarly a schematic diagram (No. 2) for explaining the train detection process relating to the substitutive safety of the ground train controller.

Meanwhile, the train detection process relating to the substitutive safety of the ground train controller 101 will be explained. The process flow of an example thereof is shown in FIG. 10. The process flow will be explained below by referring to the schematic diagrams in FIGS. 11 and 12 showing the movement between the ground and the train at that time.

Namely, firstly, at Step S10-1, whether the car ID (for example, #i) is received from at least one of the on-train communication means 205 and 206 or not is decided. If the decision shows that the car ID is not received yet, it means that the train does not arrive at the platform yet, so that until it is received, Step S10-1 is repeated. When the train arrives at the platform soon, firstly, communication between the on-train communication means 205 and the ground communication means 104 is executed, and continuously, at the point of time when the train perfectly arrives at the fixed position of the platform, communication is executed between the on-train communication means 205 and the ground communication means 103 and between the on-train communication means 206 and the ground communication means 104, thus the car ID (#i) is received by the ground train controller 101. The situation at this time is shown as State 1 in FIG. 11(A). As shown in the drawing, the situation when the train moves through the block section corresponding to the station a and then arrives at the station a is shown. In this state, the train exists on rail in the block section corresponding to the station a and does not exist in the block section corresponding to the station b.

In either case, when the car ID (#i) is received at Step S10-1, the process is moved to Step S10-2 and whether the communication between the on-train communication means 205 and the ground communication means 103 and between the on-train communication means 206 and the ground communication means 104 is finished or not is decided. If the decision shows that the communication is not finished, it means that the train is still stopped at the platform of the station a, so that the process is returned to Step S10-2, while when the communication is finished, at Step S10-3, the block section where the car 100 outgoes is processed as existence on-rail. The situation at this time is shown as State 2 in FIG. 11(B) and if the car 100 leaves the station a, it indicates that the communication between the on-train communication means 205 and the ground communication means 103 and between the on-train communication means 206 and the ground communication means 104 is finished. When the train leaves the station a, it incomes into the block section corresponding to the station b, so that the block section where the car 100 outgoes, that is, the block section corresponding to the station b is processed as existence on-rail. Thereafter, at Step S10-4, the communication is realized between the on-train communication means 206 and the ground communication means 103 and whether the car ID (#i) and the speed of the car 100 (passing speed during the communication between the on-train communication means 206 and the ground communication means 103) are received or not is decided. If the decision shows that the communication is realized and the car ID (#i) and the passing speed are received, Step S10-5 is executed and the situation at this time is shown as State 3 in FIG. 11(C). As shown in the drawing, the on-train communication means 206 is passing on the ground communication means 103, thus the communication is executed between the on-train communication means 206 and the ground communication means 103, and the car ID (#i) and the speed of the car 100 at that time are transmitted to the ground train controller 101.

The speed of the car 100 mentioned above is the speed of the train observed by the speed detector 204 in real time and the speed when the on-train communication means 206 passes on the ground communication means 103. However, when the decision at Step S104 shows that the communication is realized and the car ID (#i) and the passing speed are not received, it means that the train does not reach the State 3 yet, so that the process is returned to Step S10-4. As mentioned above, when the communication is realized and the car ID (#i) and the passing speed are received, Step S10-5 is executed and at Step S10-5, whether the received passing speed is higher than a preset value or not is decided. The preset value at this time is a speed sufficiently high, even if the train is suddenly braked and stopped after the on-train communication means 206 passes on the ground communication means 103 or an abnormal phenomenon such as wheel disconnection or tire puncture (monorails, transit) occurs, to pass the boundary between the concerned block section and the neighboring block section (the block section corresponding to the station b in FIG. 11). When the decision at Step S10-5 shows that the passing speed is higher than the set value, Step S10-8 is executed, thus the block section (the block section corresponding to the station a in FIG. 11) where the car 100 leaves is processed as regarded as no-existence.

The situation at this time is shown as State 4 in FIG. 11(D). The car 100 perfectly escapes from the block section corresponding to the station a and moves to the block section corresponding to the station b, and the block section corresponding to the station a is recognized as no-existence, and the block section corresponding to the station b is recognized as existence. Meanwhile, the passing speed exceeds the preset value, thus the block section corresponding to the station a is immediately regarded as no-existence at Step S10-8. However, to strictly reproduce the train state, after a fixed elapsed time after execution of Step S10-5, that is, after the time required to pass the boundary with the block section to which the train is to outgo from the position of the ground communication means 104 at the preset value (speed) used for comparison with the passing speed at Step S10-5, it may be considered to execute Step S10-8. Here, the aforementioned fixed time is the preset value (speed) used for comparison with the passing speed at Step S10-5 and it is defined as the time required to pass the boundary with the block section to which the on-train communication means 206 is to outgo from the position of the ground communication means 104.

In either case, when the passing speed is lower than the preset value at Step S10-5, Step S10-6 is executed. At Step S10-6, in the block section where the car 100 outgoes, in any of between the on-train communication means 205 and the ground communication means 104, between the on-train communication means 205 and the ground communication means 103, and between the on-train communication means 206 and the ground communication means 104, the communication is realized and whether the car ID is received or not is decided. If the communication is realized and the car ID is received, Step S10-7 is executed, while if not, the process is returned to Step S10-6. Here, when the passing speed is lower than the preset value at Step S10-5, a substitutive method for detecting outgoing to the neighboring block section of the car 100 is executed. The process concept in this case is shown in FIG. 12. As shown as State 1 in FIG. 12(A), when the car 100 passes the station a, the communication is executed between the on-train communication means 206 and the ground communication means 103, though the passing speed cannot exceed the fixed speed, thus as shown as State 2 in FIG. 12(B), although the train moves to the block section corresponding to the station b, the block section corresponding to the station a is kept in the existence on-rail state.

Therefore, to detect outgoing to the block section corresponding to the station b, as shown as State 3 in FIG. 12(C), after the car 100 arrives at the station b, the block section corresponding to the station a is decided as no-existence. Here, to confirm arrival of the car 100 at the station b, consistency of the car ID received at the station b with the car ID received at the station a is confirmed. At Step S10-7, whether the car ID received in the block section where the car 100 outgoes coincides with the car ID (#i) or not is decided. When they coincide with each other, Step S10-8 for deciding the block section where the car 100 leaves as no-existence is executed, while when they do not coincide with each other, the car 100 leaving the block section corresponding to the station a does not arrive at the block section corresponding to the station b, and a different train is considered to arrive, and the block section corresponding to the station a is kept in the existence on-rail state as it is.

The aforementioned explain contents indicate a decision process when one train is permitted to exist in one block section in the substitutive safety. However, as described already, during the regular safety, an existence on-rail decision process using substitutive safety equipment is executed in parallel with it. At that time, the same process as that shown in FIG. 10 is also executed, and not only existence or no-existence is just decided but also in a case of existence, information on which train exists is added and controlling items are different. At Step S10-3, the car ID of a train existing on rail is also decided as existence on rail and a plurality of car IDs are permitted. Further, in the aforementioned process, by the ground communication means 103 and 104 installed on the platform of the station, incoming of the car 100 into the station and escaping from the station can be detected immediately, so that the existence and no-existence timing executed at Steps S10-3 and S10-8 is used also by the train detection processor 402 in the regular safety and incoming into the station and escaping from the station are decided promptly and surely.

Figure 13:
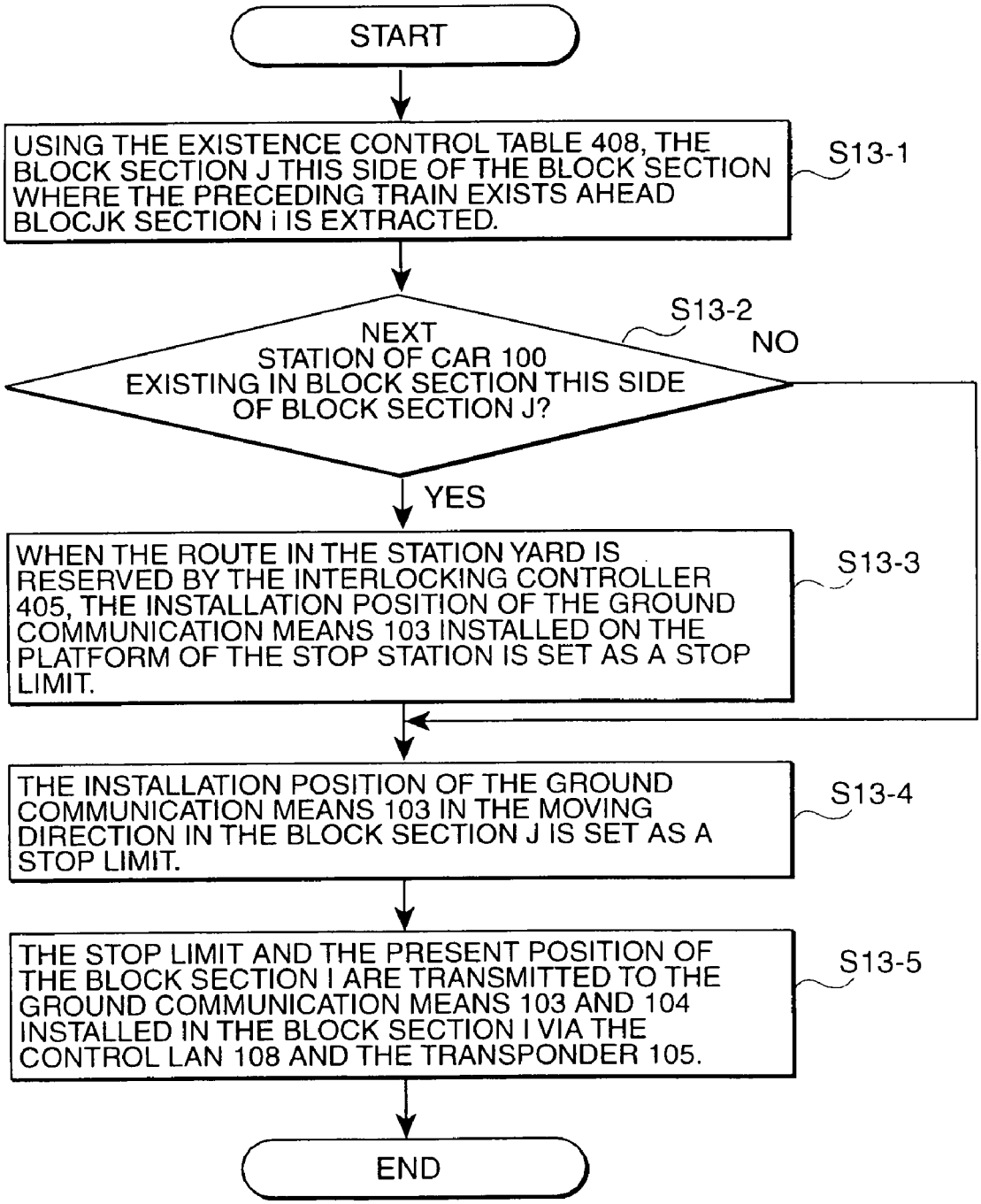
FIG. 13 is a flow chart showing the process flow of an example of the stop limit generation process relating to the substitutive safety of the ground train controller.

Continuously, the process by the stop position generation unit 410, that is, the stop limit generation process relating to the substitutive safety will be explained. The process flow of an example thereof is shown in FIG. 13. The process is basically the same as the stop limit generation process in the regular safety, though it is a great difference that the stop limit unit is the block unit. In the example shown in FIG. 13, firstly, at Step S13-1, in the stop position generation unit 410, the existence on-rail control table 408 is used, and the block section j which is positioned ahead the block section i and this side of the block section where the preceding train exists is extracted. Next, at Step S13-2, for each train, whether the preceding train of the corresponding train exists in the station yard or forward the station or not is decided. When the decision shows that no preceding train exists, Step S13-4 is executed, though when the decision shows that the preceding train exists, Step S13-3 is executed. At Step S13-4, in the block section j, the installation position of the ground communication means 103 in the moving direction is set as a stop limit. On the other hand, at Step S12-3, whether the route in the station yard is reserved by the interlocking controller 405 or not is decided. If the route is reserved, in a case of stop, the installation position of the ground communication means 103 which is installed on the platform of the stop station is set as a stop limit and in a case of passing the station, in the same way as with Step S13-4, in the block section j, the installation position of the ground communication means 103 is set as a stop limit. Further, if the route is nor reserved, the installation position of the ground communication means 103 installed in the block section this side of the block section including the station by one is set as a stop limit, thus the train is prevented from incoming into the yard. In this way, after Step S13-3 or S13-4 is executed, at Step S13-5, the generated stop limit and the present position of the block section i are transmitted to the ground communication means 103 and 104 installed in the block section i via the control LAN 108 and the transponder 105, thereby are notified to the corresponding car 100.

Figure 14:
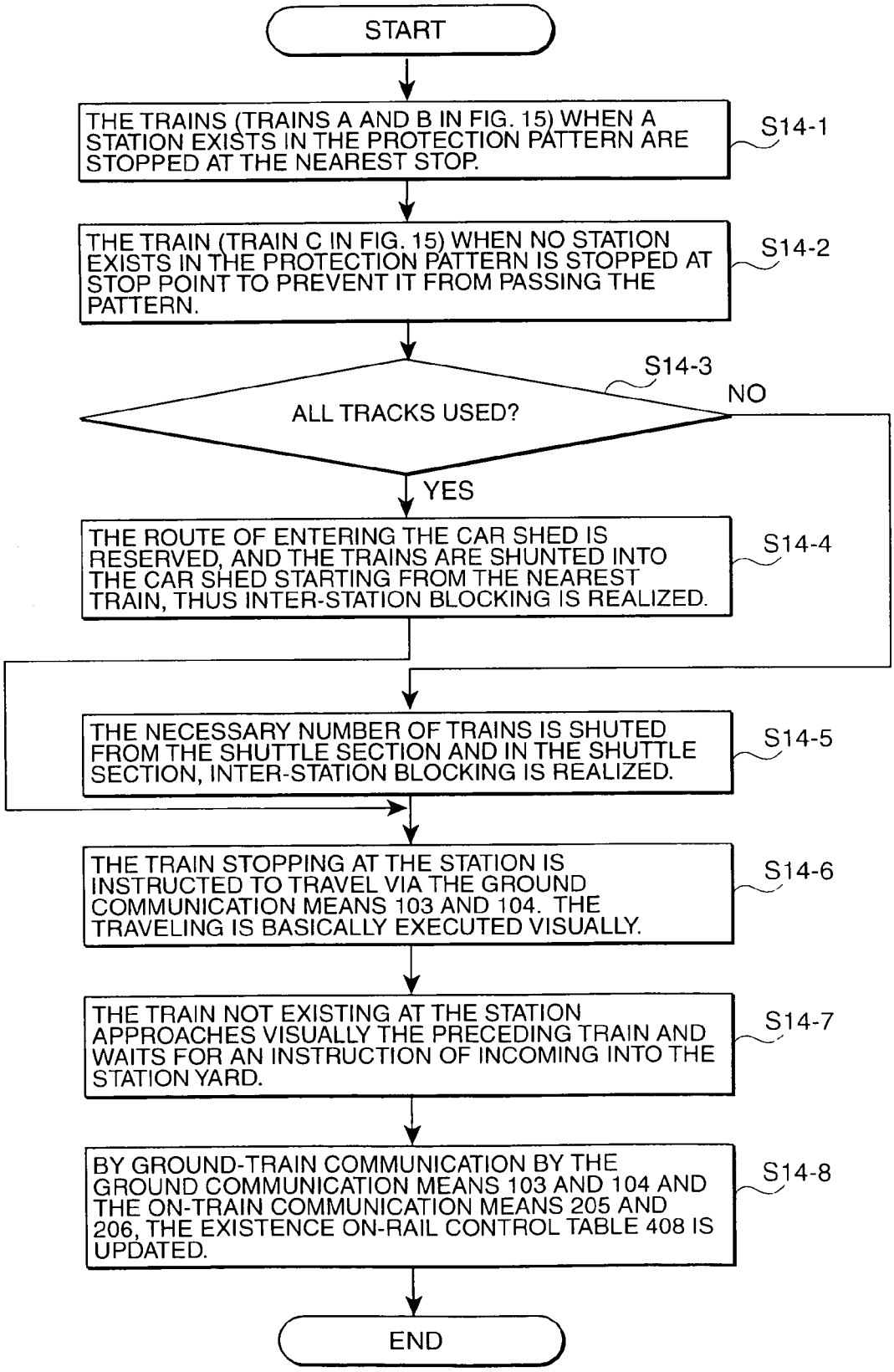
FIG. 14 is a flow chart showing the process flow of an example when the regular safety is switched to the substitutive safety.
Figures 15, 16:
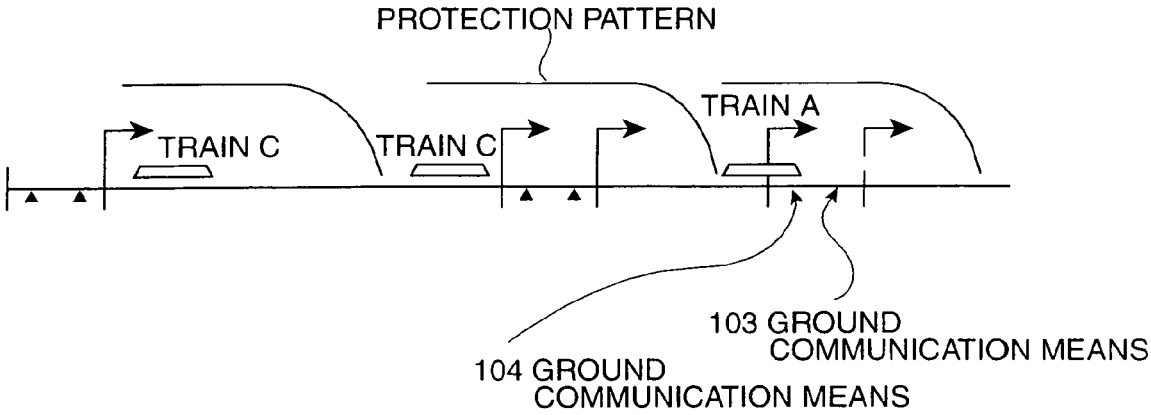
FIG. 15 is a schematic diagram for explaining the switching process.
FIG. 16 is a drawing showing an existence on-rail control table provided in each of the terminals.

Furthermore, the operation procedure when switching the regular safety to the substitutive safety will be explained. The process flow of an example thereof is shown in FIG. 14. As mentioned above, in the substitutive safety, the fixed block section decided by the installation positions of the ground communication means 103 and 104 is defined and control for permitting only one train to exist in the block section is executed, so that the state that a plurality of trains exist in one block section is switched to the state of one train in one block. FIG. 14 shows the process flow for it. Hereinafter, the space between neighboring stations is often set to one block section, so that the state of one train in one block is referred to as inter-station one block and the process flow thereof will be explained below. Firstly, at Step S14-1, as shown in FIG. 15, the trains (the train A and train B conform to) when the station exists in the protection pattern are stopped at the nearest station. This is other than train radio used for calling between operators (hereinafter referred to as train radio) and is executed for the purpose of effectively using the ground communication means 103 and 104 which are the one means for enabling communication between the ground and the train. Next, at Step S14-2, the train (the train C conforms to) when no station exists in the protection pattern is stopped at the stop point to prevent it from passing the protection pattern. Thereafter, at Step S14-3, a plan of whether or not to use all tracks, that is, using all the operation districts or partially using them by shuttle is formed. When using all the tracks, Step S14-4 is executed, and when not using all the tracks, Step S14-5 is executed. At Step S14-4, to use all the tracks, trains incapable of entering the block section are shunted to the car shed. Concretely, by an operator controlled by the center, the route for entering the car shed is reserved and the trains are shunted to the car shed starting from the nearest train, thus inter-station one block is realized.

On the other hand, at Step S14-5, not to use all the tracks by the shuttle operation, the necessary number of trains are shunted from the shuttle section outside the shuttle section and in the shuttle section, inter-station one block is realized. After Step S14-4 or S14-5 is executed, at Step S14-6, the existence on-rail control table 408 is referred to, and to the train stopping at the station, according to the policies at Steps S14-4 and S14-5, a travel instruction is given via the ground communication means 103 and 104, thus the train travels. The traveling in this case is basically visual traveling by an operator. Thereafter, at Step S14-7, to a train not existing at the station, an instruction is given by train radio so as to visually approach the preceding train and wait for an incoming instruction into the station yard. Furthermore, thereafter, at Step S14-8, by communication between the ground and the train by the ground communication means 103 and 104 and the on-train communication means 205 and 206, the existence on-rail control table 408 is updated. By the aforementioned process, inter-station one block is realized. At this time, by the communication between the ground and the train by the ground communication means 103 and 104 and the on-train communication means 205 and 206, the train existence on rail is automatically controlled and transfer to the substitutive safety can be executed free of contradiction.

When the substitutive safety is to be executed, in the ground train controller 101, as mentioned above, the method for automatically executing the train control by existence on-rail detection and stop limit generation is used. This is strictly on condition that the ground train controller 101 is operated normally. To increase more the operation rate for the safety operation, even when any failure occurs in the ground train controller 101, the necessity of substitutive safety is considered to be high. Here, the substitutive safety when a failure occurs in the ground train controller 101 using the aforementioned system constitution will be explained. Even when the center (the ground train controller 101) is in the down state, the existence on rail is automatically confirmed by a local device and under the sure decision of existence on rail, the operation by station deal is continued. Concretely, the aforementioned terminal 109 has a relay transmission function of a message transferred between the ground train controller 101 and the car 100. However, the terminal 109 itself is structured as a fail safe part having a multiple CPU and when a message from the car 100 is transmitted to the ground train controller 101 via the control LAN 108, the message is fetched by the terminal 109, and by the process shown in FIG. 10, existence or no-existence of a train before and after the block section including the ground communication means 103 and 104 connected to the terminal 109 is confirmed by the terminal 109.

In other words, the same process as the existence on-rail decision process executed by the ground train controller 101 is executed locally by the respective terminals 109 on condition that the range is limited. More concretely, a message from the car 100 which is transmitted via the ground communication means 103 and 104 respectively installed in the neighboring block section and the block section in charge is collected and confirmed directly or indirectly by the respective terminals 109, thus existence on rail is decided. At that time, on the terminals 109, separately from the central existence on-rail control table 408, a local existence on-rail control table is provided, thus the existence on rail is controlled by the existence on-rail control table. In FIG. 16, an existence on-rail control table 1600 provided in the respective terminals 109 is shown. The terminals 109 and the ground communication means 103 and 104 are in correspondence with each other and in this case, assuming the block section (own station) including the ground communication means 103 and 104 corresponding to a certain terminal 109 as I, on the existence on-rail control table 1600, existence on rail in not only the block section I but also the neighboring block sections (neighboring stations) I−1 and I+1 is controlled. Even if a failure occurs in the ground train controller 101 like this, sure existence on-rail confirmation including not only the own station but also the neighboring stations is enabled, and the safety of the operation by station deal can be improved, so that the operation maintaining high safety can be continued. Meanwhile, on the existence on-rail control table 1600, the state that the train "t1" exists only in the block section I that the own station is in charge of is shown.

Figure 17:
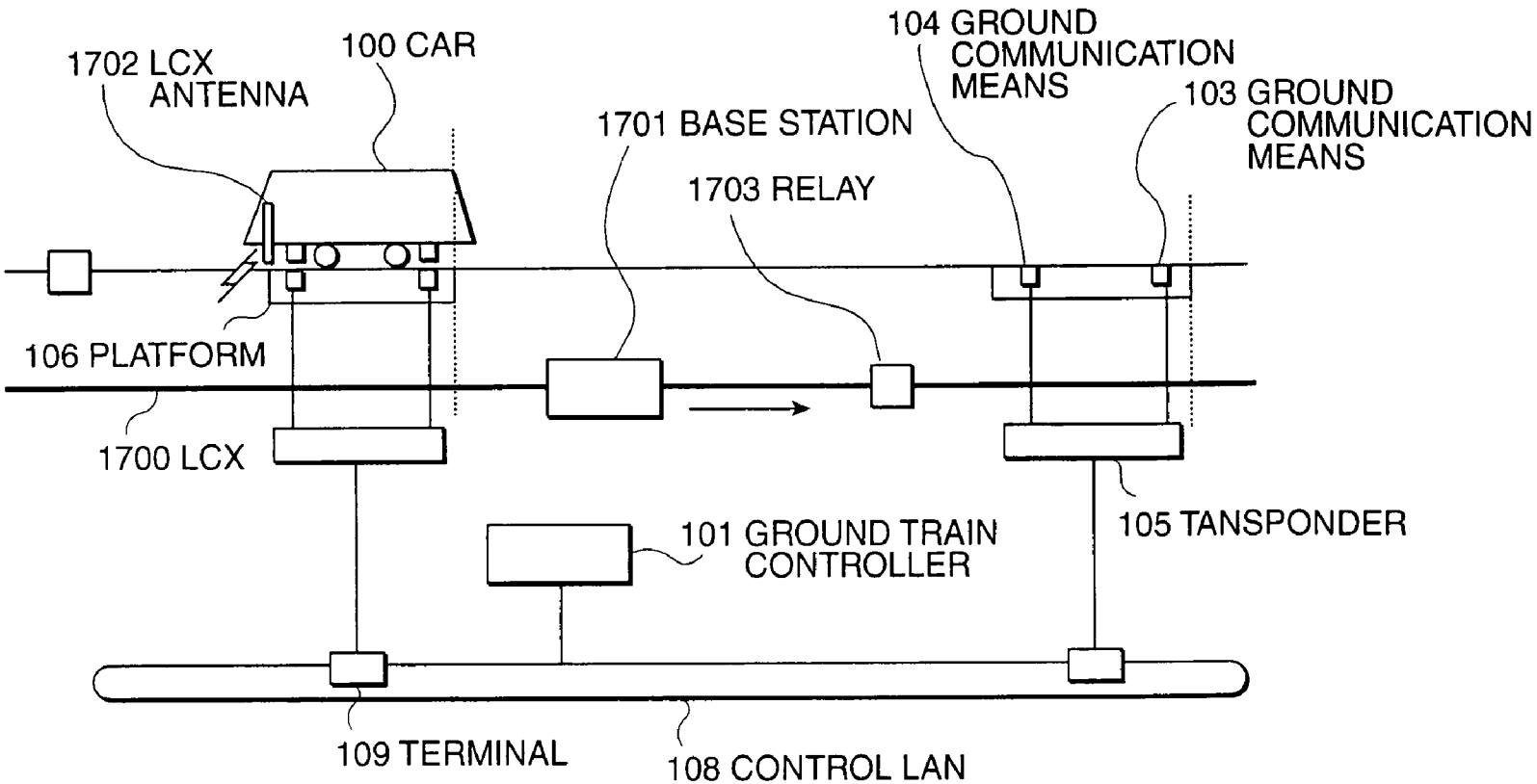
FIG. 17 is a diagram showing the whole schematic system configuration of an example of the signaling safety system of the present invention when an LCX (leaking coaxial cable) is used as a radio communication medium.
Figure 18:
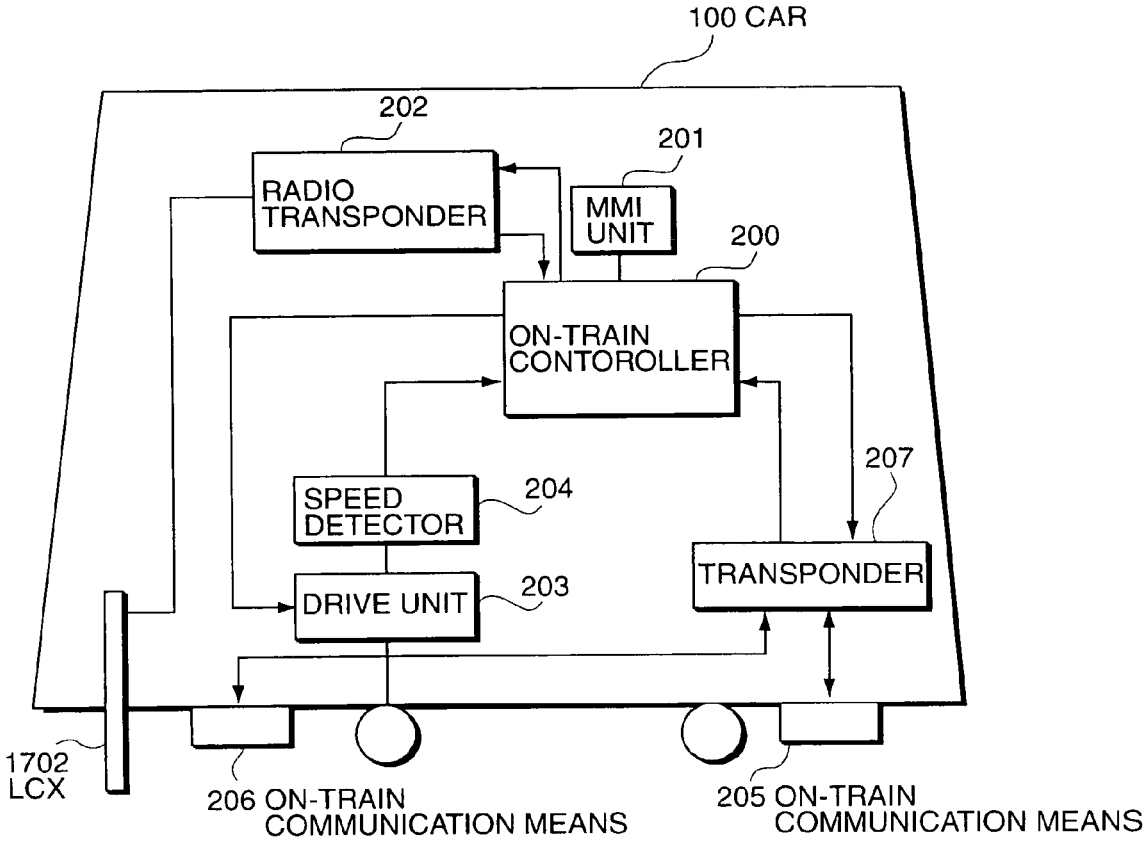
FIG. 18 is a diagram showing the constitution of an example of the car of the signaling safety system.

Finally, the ground-train communication in the regular safety will be given a supplementary explanation. For the communication, in place of use of radio of space waves, as shown in FIG. 17, an LCX (leaking coaxial cable) 1700 may be used as a radio communication medium. The constitution of an example of the car 100 in this case is shown in FIG. 18. As shown in FIGS. 17 and 18, in place of the base station 102 and the antenna 107 shown in FIG. 1, a base station 1701, an LCX antenna 1702, and a repeater 1703 are installed. The aforementioned LCX is a cable for enabling communication in a limited space around the coaxial cable and when the LCX is laid along the track, in the same way as with communication by radio of space waves, the car 100 and the ground train controller 101 can continuously communicate with each other, so that from the viewpoint of function, there are no differences from the constitution shown in FIG. 1. Namely, by use of the LCX, by the exactly same method, the signaling safety control can be executed. The maximum advantage in use of the LCX is that the communication in a limited space around the cable is premised, so that a situation that the reception sensitivity is changed due to changes in the environment like space waves and the performance is deteriorated does not occur. In other words, the system is resistant to disturbance of environment changes and the reliability of regular safety can be improved. However, the system is still weak to disturbance such as disturbing radio waves and it is a disadvantage in execution that the installation expense and maintenance expense are great compared with space waves. Further, as a cable having the same function as that of the LCX, an inductive wire with transposition used in LZB in Germany may be considered and by use of it, ground-train communication can be realized. However, when using an LCX, one coaxial cable may be installed in a position capable of communicating with the train side, while when using an inductive wire with transposition, an inductive wire must be transposed at regular intervals and laid by burying, an d the installation and maintenance expense is generally great compared with the LCX.

As explained above, in the radio system, position detection estimating errors such as transmission delay is executed, so that quick confirmation of incoming and out going in the station yard is difficult. However, balises (the balises can transmit installation position information, so that they can be replaced with balises for position correction) are installed at the station, so that quick confirmation of position detection is enabled and the safety can be improved. Further, at the necessary parts of the station as a basis, balises capable of communicating between the ground and the train are installed, and on the train side, information such as the car ID, speed, and moving direction is received from a train using them, so that the train transition before and after the boundary of balises at the installation part is confirmed, and the existence on rail is controlled, and the train stop limit information is simultaneously transmitted to the train, thus the train control and safety control can be executed. Furthermore, even if a failure occurs in radio, the safety control by existence on-rail detection and train control using the balises capable of communicating between the ground and the train is continued, so that the operation rate can be improved. Furthermore, it can be applied to all systems for operating not only railroads but also tracks composed of lines.

The invention made by the inventors is concretely explained above on the basis of the embodiment. However, the present invention is not limited to the aforementioned embodiment and needless to say, within a range which is not deviated from the object of the present invention, the present invention can be modified variously.

What is claimed is:

1. A signaling safety system having an on-ground segment and an on-train segment, wherein:

said on-train segment comprises, an on-train radio transmitter-receiver that is coupled for radio communication with said on-ground segment;

an on-train additional communication device for transmitting train position information to said on-ground segment when the train approaches to a specific position range;

an on-train controller for receiving moveable area boundary information for the train from said on-ground segment, via either said on-train radio transmitter-receiver or said on-train additional communication device, and conducting speed control of the train based on said boundary information; and said on-ground segment comprises, an on-ground radio transmitter-receiver that is coupled for radio communication with said on-train segment;

an on-ground additional communication device for receiving said train position information from said on-train segment when said train approaches the specific range; and an on-ground train controller having (i) a train detection processor for detecting presence of the train based on said position information, and (ii) a stop position generation unit for generating moveable area boundary information, wherein said generating boundary information is communicable to said on-train segment via either of said on-ground radio transmitter-receiver or said on-ground additional communication device.

2. A signaling safety system according to claim 1, wherein at least two of said on-train additional communication devices are installed on said train.

3. A signaling safety system according to claim 1, wherein said on-ground additional communication device transmits information including at least one of identification information, speed information, and moving direction information of said train.

4. A signaling safety system according to claim 1, wherein in a block section using installation positions of said on-ground additional communication devices as a boundary, in which only one train is permitted to be present on-rail, when speed information regarding said train is higher than a fixed speed, it is determined that said train goes into a neighboring block section.

5. A signaling safety system according to claim 1, wherein when radio communication of said boundary information from said on-ground radio transmitter-receiver to said on-train radio transmitter-receiver cannot be used, said communication is switched such that said boundary information is communicated from said on-ground additional communication device to said on-train additional communication device.

6. A signaling safety system according to claim 1, wherein said on-ground additional communication devices are installed at least in a station yard.

* * * * *